US005797443A

United States Patent [19]

Lin et al.

[11] Patent Number: 5,797,443

[45] Date of Patent: Aug. 25, 1998

[54] METHOD OF CASTING ARTICLES OF A BULK-SOLIDIFYING AMORPHOUS ALLOY

[75] Inventors: Xianghong Lin, Laguna Niguel; William L. Johnson, Pasadena; Atakan Peker, Aliso Viejo, all of Calif.

[73] Assignees: Amorphous Technologies International, Laguna Niguel; California Institute of Technology, Pasadena, both of Calif.

[21] Appl. No.: 720,483

[22] Filed: Sep. 30, 1996

[51] Int. Cl.[6] ..... B22D 46/00; B22D 27/04; C22C 45/10; C22C 45/00

[52] U.S. Cl. ..... 164/4.1; 164/113; 164/122; 148/403; 148/538

[58] Field of Search ..... 164/122, 113, 164/451, 463, 452, 4.1; 148/672, 538, 403

[56] References Cited

U.S. PATENT DOCUMENTS

| | | | |
|---|---|---|---|
| 5,225,004 | 7/1993 | O'Handley et al. | 164/463 |
| 5,288,344 | 2/1994 | Peker et al. | 148/403 |
| 5,368,659 | 11/1994 | Peker et al. | 148/403 |
| 5,567,251 | 10/1996 | Peker et al. | 148/552 |

OTHER PUBLICATIONS

Ovid Eshbach et al., "Handbook of Engineering Fundamentals", Section 12, Heat Transfer, *John Wiley & Sons*, pp. 1113–1119 (1975).

Advertisement, "ProCAST . . . not just for casting", Source and date unknown.

D.E. Polk et al., "The Effect of Oxygen Additions on the Properties of Amorphous Transition Metal Alloys," in Rapidly Quenched Metals III, vol. 1, *The Metals Society*, pp. 220–230 (1978).

*Primary Examiner*—Patrick Ryan
*Assistant Examiner*—I.- H. Lin
*Attorney, Agent, or Firm*—Gregory Garmong

[57] ABSTRACT

A casting charge of a bulk-solidifying amorphous alloy is cast into a mold from a temperature greater than its crystallized melting temperature, and permitted to solidify to form an article. The oxygen content of the casting charge is limited to an operable level, as excessively high oxygen contents produce premature crystallization during the casting operation. During melting, the casting charge is preferably heated to a temperature above a threshold temperature to eliminate heterogeneous crystallization nucleation sites within the casting charge. The casting charge may be cast from above the threshold temperature, or it may be cooled to the casting temperature of more than the crystallized melting point but not more than the threshold temperature, optionally held at this temperature for a period of time, and thereafter cast.

19 Claims, 5 Drawing Sheets

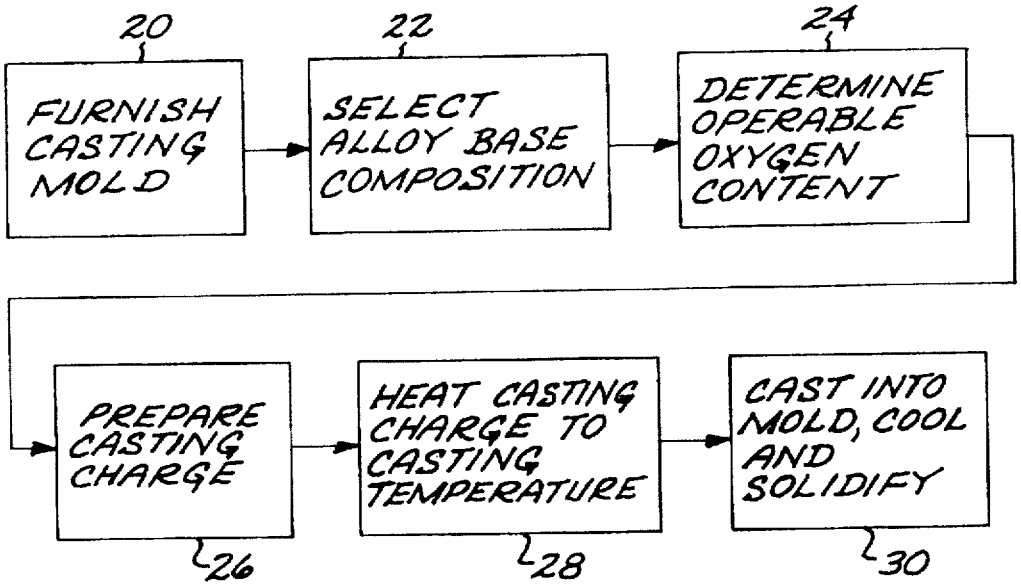
FIG. 1
FIG. 2
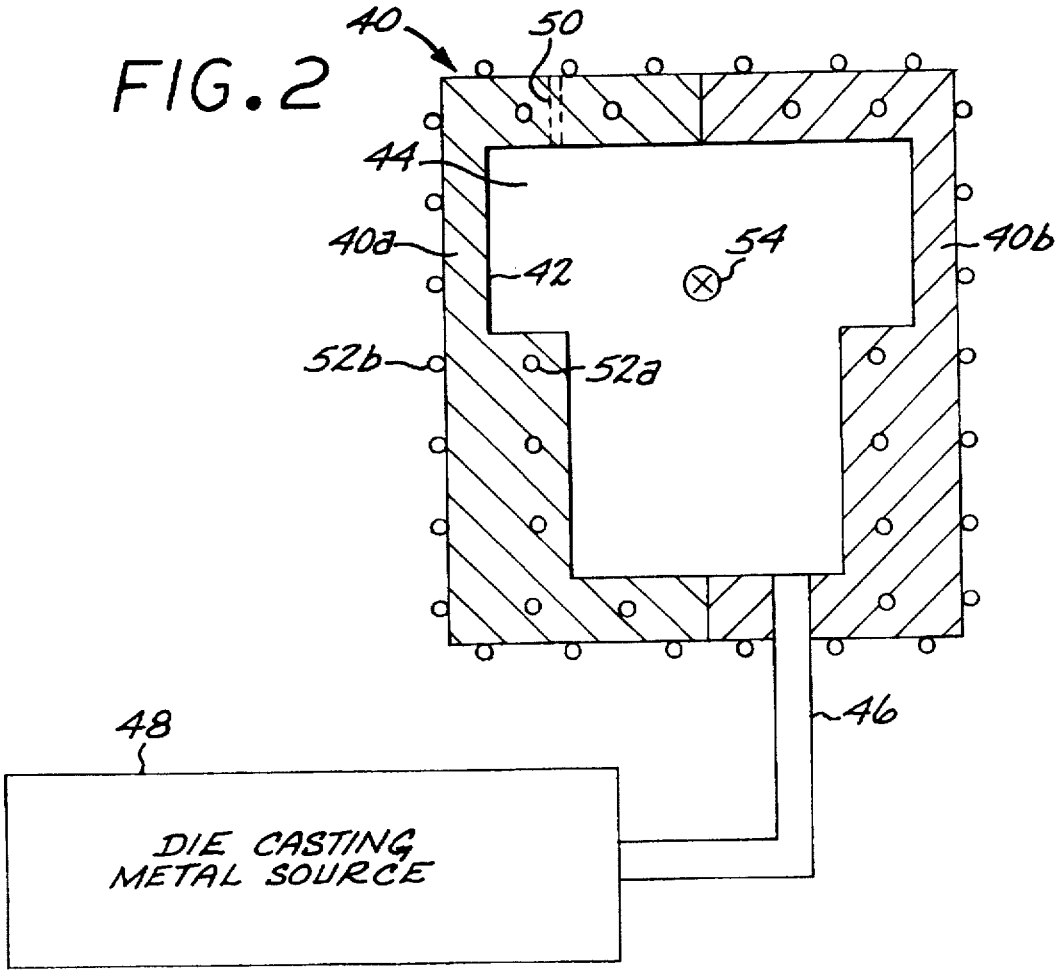

METHOD OF CASTING ARTICLES OF A BULK-SOLIDIFYING AMORPHOUS ALLOY

The U.S. Government has certain rights in this invention pursuant to Grant No. FG03-86ER45242 awarded by the department of Energy.

BACKGROUND OF THE INVENTION

This invention relates to the melting and casting of articles, and, more particularly, to the melting and casting of articles made of bulk-solidifying amorphous alloys.

A large portion of the metallic alloys in use today are processed by solidification casting, at least initially. The metallic alloy is melted and cast into a metal or ceramic mold, where it solidifies. The mold is stripped away, and the cast metallic piece is ready for use or for further processing.

Bulk-solidifying amorphous alloys are a recently developed class of metallic materials. These alloys may be solidified and cooled at relatively slow rates and retain the amorphous, non-crystalline (that is, glassy) state at room temperature. This amorphous state is highly advantageous for certain applications. However, if the cooling rate is too slow, the alloy may transform to a crystalline state during cooling, so that the benefits of the amorphous state are lost.

The as-cast structure of most materials produced during solidification and cooling depends upon the cooling rate. There is no general rule for the nature of the variation, but, for the most part, the structure changes only gradually with changes in cooling rate. For the bulk-solidifying amorphous alloys, on the other hand, the change between the amorphous state produced by relatively rapid cooling and the crystalline state produced by relatively slower cooling is one of kind rather than degree—the two states have quite different properties.

It is therefore important to understand and precisely control the casting procedure for bulk-solidifying amorphous alloys. Care must be taken so that the solidification mold for the bulk-solidifying amorphous alloy is designed properly, and that the article being cast permits heat to be removed at a sufficiently high rate to achieve the necessary cooling rate.

As the inventors have gained experience with the casting of bulk-solidifying amorphous alloys, it has become clear to them that other factors beyond mold design may influence the ability to cast amorphous parts of the bulk-solidifying amorphous alloys, particularly for large articles. There is accordingly a need to closely control the product design and casting operation to ensure that the cast article is amorphous. The present invention fulfills this need for at least one factor that has been discovered to be important to the ability to retain an amorphous structure upon casting, and further provides related advantages.

SUMMARY OF THE INVENTION

The present invention provides a method for casting articles of an amorphous alloy. The approach provides for the selection of a processing procedure and an alloy composition that are adapted to the article being cast. The alloy composition is selected to be operable so that the resulting article is amorphous, and, additionally, the article has minimal material cost. The latter is a particularly important consideration, because the constituents of many amorphous alloy compositions are relatively costly.

In accordance with the invention, a method for casting an article of a bulk-solidifying amorphous metallic alloy comprises the steps of furnishing a casting mold defining the shape of the article and selecting a bulk-solidifying amorphous metallic alloy base composition. The base composition is a composition selected from an alloy class whose members may be cooled from a casting temperature greater than a crystallized melting temperature of the composition, yet retain an amorphous metallic state. Preferably, the base composition is a bulk-solidifying amorphous alloy, which may be cooled from the melt at a cooling rate of less than about 500° C. per second, yet retain an amorphous metallic state. The method further includes determining an operable oxygen content of the base composition for casting the base composition in the casting mold while retaining an amorphous structure. A casting charge of the base composition and with an oxygen content of no greater than the operable oxygen content is prepared, heated to a casting temperature greater than the crystallized melting temperature of the casting charge, cast into the casting mold, and permitted to cool and solidify.

The operable oxygen content of the base composition is preferably determined by obtaining a family of TTT (time-temperature-transformation) crystallization curves of the amorphous metallic alloy for a range of oxygen contents. A critical cooling curve experienced at a selected cooling location within the article during casting of the bulk-solidifying amorphous metallic alloy in the casting mold from the casting temperature is established, typically from a heat-flow analysis of the mold design and the base composition. An oxygen content for the base composition is selected such that the critical cooling curve does not intersect the TTT crystallization curve for the selected oxygen content. Most preferably, the selected oxygen content is the maximum oxygen content that exhibits a TTT crystallization curve which is not intersected by the critical cooling curve on a temperature-time plot.

The inventors have found that the position of the TTT crystallization curve of bulk-solidifying amorphous alloys is highly sensitive to the oxygen content of the material. A difference of less than 1000 ppm (parts per million) in the oxygen content may drastically alter the behavior of the material by moving the TTT crystallization curve from a position where the article of interest may be easily cast with the amorphous state to a position where it is virtually impossible to cast the article with the amorphous state.

It is not possible to state a specific value of the oxygen content which is universally applicable to all articles and amorphous-metal compositions. The permitted oxygen content depends upon the nature of the article, the type of mold, and the base composition of the amorphous alloy. However, the method set forth herein permits those skilled in the art to follow a specific procedure for determining the permitted oxygen content for any set of conditions.

The selection of the oxygen content for the casting charge is an important technical and cost consideration in the production of cast articles from the bulk-solidifying amorphous alloys. If the oxygen content is too high, the article cannot be prepared by the selected casting technique. Regions in the center of the article (that is, most remote from the mold walls) will exhibit a crystallized structure rather than the desired amorphous state. On the other hand, selection of an oxygen content that is lower than necessary results in significantly higher product cost. The cost of the raw materials that are used in many bulk-solidifying amorphous alloys, zirconium and titanium in particular, increases with decreasing oxygen content. For example, the cost of a pound of zirconium metal having 1400 ppm oxygen is much less than the cost of a pound of zirconium metal having 400 ppm oxygen. The present approach allows the process design engineer to select an oxygen content for the bulk-solidifying amorphous alloy that has an oxygen content which is sufficiently low to permit the article to be cast, but no lower than necessary (with a safety margin, if desired) so as not to needlessly increase the cost of the raw material.

Initial studies indicate that other elements including carbon, sulfur, and nitrogen may have similar effects to those of oxygen on the castability of the amorphous alloys in the amorphous state.

The present approach also provides for negating the adverse effects of the oxygen present in the amorphous alloy as much as possible. Preferably, when the casting charge is heated to the casting temperature just prior to casting into the mold, it is overheated to a threshold temperature sufficiently greater than the crystallized melting temperature that heterogeneous crystallization nucleation sites previously present within the casting charge are reduced or eliminated. The casting charge may thereafter be cast directly into the mold from the threshold temperature, or cooled to a lower casting temperature, held for a period of time, and then cast into the mold.

The present approach provides a technique for producing articles of bulksolidifying amorphous alloys that is technically operable and economically attractive. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a block flow diagram of a preferred method for practicing the invention;

FIG. 2 is schematic sectional view of a casting mold;

DETAILED DESCRIPTION OF THE INVENTION

Figure 3:
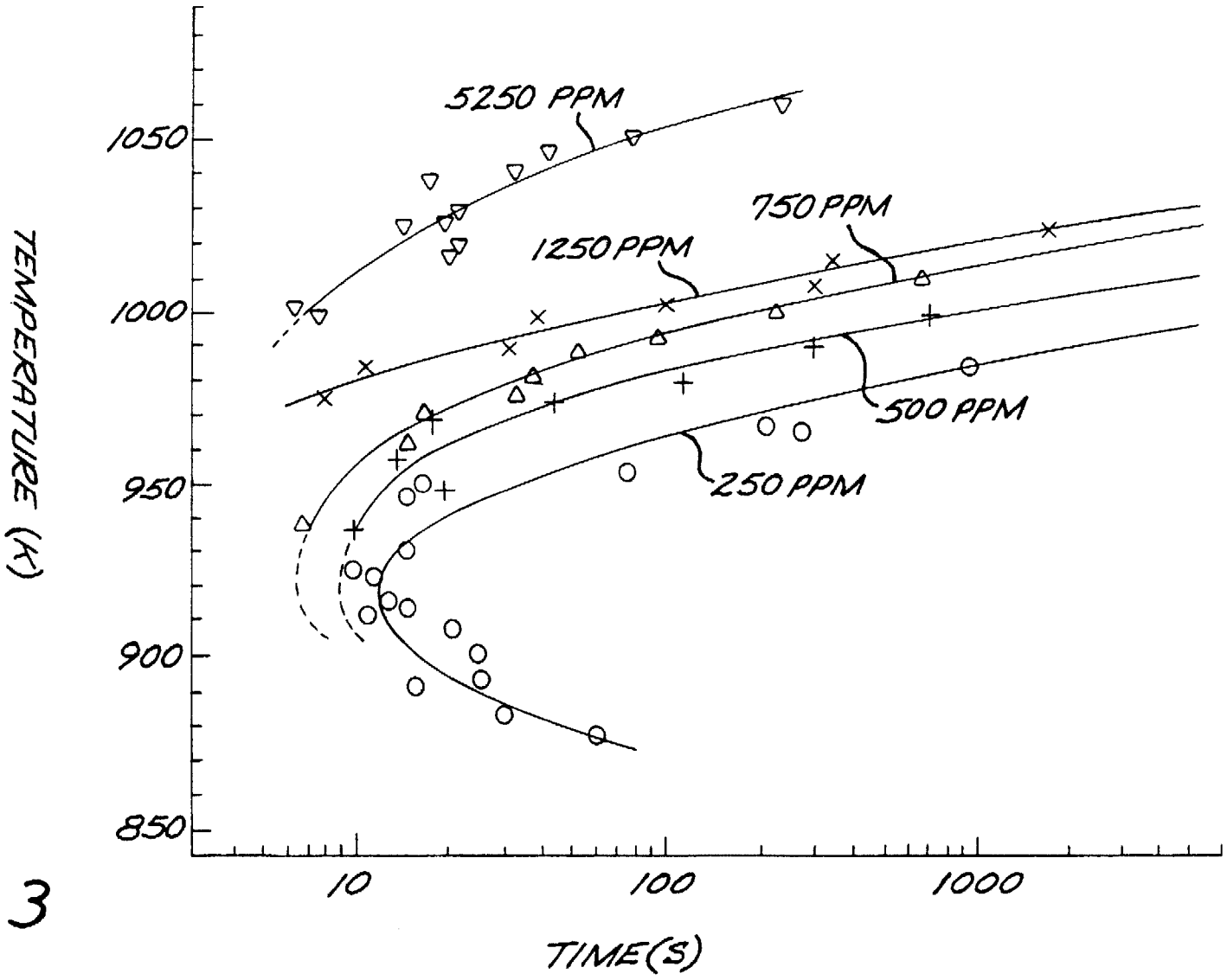
FIG. 3 is a graph of temperature as a function of time, illustrating a family of measured TTT (time-temperature-transformation) crystallization curves for a bulk-solidifying amorphous alloy for various oxygen contents of the alloy.

FIG. 1 depicts a preferred approach for practicing the invention. A casting mold is furnished, numeral 20. Any operable form of closed or otherwise bounded mold may be used. FIG. 2 illustrates a preferred form of a mold, a die casting mold 40. The die casting mold 40 includes two mating halves 40*a* and 40*b*. A mechanism (not shown) moves the two halves 40*a* and 40*b* between the mated position as illustrated, and a separated position (not shown). An interior wall 42 of the mold 40 defines a die cavity 44 having the shape of the article to be cast. A casting charge of molten metal is introduced into the die cavity 44 through a sprue (passage) 46 from a die-casting metal source 48. The die-casting metal source 48 typically includes a heater for heating the metal and forcing it under pressure from the metal source 48, through the sprue 46, and into the die cavity 44. Air within the die cavity 44 is evacuated or allowed to escape under its own pressure from a vent 50, as the charge of molten metal flows into the die cavity. The mold halves 40*a* and 40*b* are cooled by water running through cooling means 52, such as internal channels 52*a* and/or external pipes 52*b*.

The die casting operation and apparatus operates in a reciprocating fashion. With the mold halves 40*a* and 40*b* mated together as illustrated, metal is introduced into the die cavity 44 from the metal source 48. Heat is removed from the metal by other cooling means 52*a* and 52*b* so that the metal cools and solidifies to form the desired article. The mold halves 40*a* and 40*b* are thereafter separated and the solid article is removed. The halves 40*a* and 40*b* are closed together again, and the process is repeated.

The physical characteristics of the die casting mold 40 are readily obtained. The dimensions are established by the size of the article that is to be die cast. The thermal properties of the mold material and the heat removal rate by the cooling means 52 are typically known, but if not may be readily calculated or measured.

It is known to cast amorphous alloys against open molds such as chill plates, chill rolls, ingot forms, and the like. In this case, the same procedure as discussed below is followed, using the appropriate cooling rate determinations in step 24. Thus, the term "casting mold" does not imply the use of a closed mold such as a die casting mold. It only requires that the mold define at least a portion of the surface of the cast article.

A metallic alloy base composition is selected, numeral 22 of FIG. 1. As used herein, the "base composition" is a composition selected from a metallic alloy class whose members may be cooled from a casting temperature greater than a crystallized melting temperature of the composition, yet retain an amorphous metallic structure. Preferably, the base composition is a composition of a bulk-solidifying amorphous metal that is capable of being cooled from the melt at a cooling rate of about 500° C. per second or less, yet retain an amorphous structure. However, the invention is more broadly applicable to other alloys that require higher cooling rates to retain the amorphous state. For example, some amorphous alloys normally require cooling rates of $10^4$–$10^6$° C. or more to retain the amorphous state, and such alloys also fall within the scope of the present invention but are less preferred than the bulk-solidifying amorphous alloys because they cannot be used to cast thick sections.

The "base composition" is the composition of the casting charge except for the oxygen that is present in the casting charge. The base composition is selected so as to provide the desired properties of the final cast article. As will be discussed, the oxygen content of the casting charge plays a major role in the castability of the alloy, but to a first approximation it plays a relatively minor role in the final properties of the solid article in the oxygen ranges of interest such as a few thousand parts per million or less. The base composition can therefore be selected to provide the required properties in the final article, and the oxygen content thereafter selected to permit the article to be cast.

The preferred amorphous alloy is a metal alloy that may be cooled from the melt to retain the amorphous form in the solid state, on the order of about 500° C. per second or less, yet retain an amorphous structure after cooling, termed herein a "bulk solidifying amorphous metal". These bulk-solidifying amorphous metals do not experience a liquid/solid crystallization transformation upon cooling at sufficiently high rates, as with conventional metals. Instead, the highly fluid, non-crystalline form of the metal found at high temperatures becomes more viscous as the temperature is reduced, eventually taking on the outward physical properties of a conventional solid but having a non-crystalline, amorphous structure.

The amorphous alloy composition may exist in either an amorphous state or a crystallized state. The amorphous state is retained upon cooling from the melt at a sufficiently high rate, and the crystallized form is produced upon cooling at lower rates or under conditions where the amorphous state is first produced but subsequently crystallized. A "crystallized melting temperature" $T_L$ may be defined for the composition as the temperature at which the alloy becomes fully liquid upon heating, when the alloy composition in its crystallized state is heated. That is, the alloy composition is prepared in its crystallized state, and then heated to a temperature at which it becomes fully liquid, usually termed the "liquidus temperature". This temperature is the crystallized melting temperature. When the alloy composition is at a temperature above $T_L$, there is no tendency to crystallize.

A most preferred type of bulk-solidifying amorphous alloy has a composition near a eutectic composition, such as a deep eutectic composition with a eutectic temperature on the order of 660° C. This material has a composition, in atom percent, of from about 45 to about 67 percent total of zirconium plus titanium, from about 10 to about 35 percent beryllium, and from about 10 to about 38 percent total of copper plus nickel, the total of the percentages being 100 atomic percent except for minor impurities. A substantial amount of hafnium can be substituted for some of the zirconium and titanium, and up to a few percent of iron, chromium, molybdenum, or cobalt can be substituted for some of the copper and nickel. A most preferred such metal alloy material has a composition, in atomic percent, of about 41.2 percent zirconium, 13.8 percent titanium, 10 percent nickel, 12.5 percent copper, and 22.5 percent beryllium. This bulk-solidifying alloy is known and is described in U.S. Pat. No. 5,288,344.

Another bulk-solidifying amorphous alloy material has a composition, in atom percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent except for minor impurities. A most preferred metal alloy of this group has a composition, in atomic percent, of about 60 percent zirconium, about 15 percent aluminum, and about 25 percent nickel. This alloy system is less preferred than that described in the preceding paragraph.

Another preferred composition has no beryllium. This alloy has a composition, in atom percent, of from about 49 to about 64 percent copper, from about 19 to about 41 percent titanium, from about 4 to about 21 percent zirconium plus hafnium, and from about 2 to about 14 percent nickel plus cobalt, the total of the percentages being 100 atomic percent except for minor impurities.

Another operable alloy has a composition, in atom percent, of from about 8 to about 42 percent copper, from about 5 to about 20 percent titanium, from about 30 to about 57 percent zirconium plus hafnium, and from about 4 to about 37 percent nickel plus cobalt, the total of the percentages being 100 atomic percent except for minor impurities.

Another operable alloy has a composition, in atom percent, of from about 45 to about 65 percent zirconium plus hafnium, from about 4 to about 7.5 percent titanium plus niobium, from about 5 to about 15 percent aluminum plus zirconium, balance copper, nickel and cobalt, with the proviso that the ratio of the copper to the total of nickel, cobalt, and iron is between 1:2 and 2:1, the total of the percentages being 100 atomic percent except for minor impurities.

Many of the alloys contain substantial amounts of zirconium and/or titanium, and the present invention is preferably used with such alloys.

The thermal properties of the alloys, such as thermal conductivity and thermal diffusivity, are known or readily measured by conventional procedures. The thermal impedance against the mold material of the casting mold is known or readily measured by conventional procedures.

An operable oxygen content of the casting charge is determined, numeral 24 of FIG. 1, taking into account the composition of the casting charge, the nature of the article being cast, and the casting process. The "operable oxygen content" is an oxygen concentration which, when present in or added to the base composition, permits the selected article to be cast by the selected technique. The operable oxygen content is determined by any operable technique. The operable oxygen content is preferably determined using time-temperature-transformation ("TTT") crystallization diagrams for the base composition with controlled amounts of oxygen present. TTT diagrams are well known in the field of metallurgy for use in other applications, in particular phase transformations in steels.

The TTT diagram may be used to depict the crystallization behavior of amorphous alloys. FIG. 3 shows a family of measured TTT curves of the amorphous-to-crystallized transformation in a base composition of an amorphous alloy containing, in atomic percent, 52.5 percent zirconium, 5 percent titanium, 17.9 percent copper, 14.6 percent nickel, and 10 percent aluminum, plus controlled amounts of oxygen. The TTT diagram curves were prepared in a manner similar to that used to prepare TTT diagrams for phase transformations in steels. Alloys of the base composition with various controlled amounts of oxygen—5250 ppm (parts per million), 1250 ppm, 750 ppm, 500 ppm, and 250 ppm—were prepared. Specimens of the alloys were heated to a temperature of above the value of $T_{th}$ and then cooled to various temperatures, held for various times, and quenched to room (ambient) temperature. The specimens were measured to determine whether they were amorphous or crystalline. The boundary between the time prior to crystallization and the time after which crystallization had occurred is plotted in FIG. 3 for each of the oxygen contents. Some of the TTT curves exhibit a "nose" at the minimum time for crystallization transformation at some intermediate temperature.

A critical cooling curve experienced at a cooling location within the article during casting of the cast charge in the casting mold is determined. Referring to FIG. 2, the cooling curve at any location within the mold may be determined either by measurements or by a conventional heat flow calculation. As a practical matter, it is not necessary to determine the cooling curves for all points, only those at points where it is desired to retain an amorphous structure and which have the slowest cooling rates. In most cases, it will be desired to retain the amorphous structure throughout the entire article, but there may be situations where it is desired to retain the amorphous structure near the surface of the article and allow crystallization to occur within the interior of the article.

The following discussion will address the case of most interest to the inventors, retaining the amorphous state throughout the entire article, but its principles are readily extended to cases where the amorphous state need only be retained at particular locations. From experience, it is known that the slowest cooling rate is typically found at the location furthest from the internal walls 42, the cooling location X, numeral 54. The critical cooling curve at location X, numeral 54, is estimated by the use of heat flow calculational procedures such as those described in Eshbach et al., "Handbook of Engineering Fundamentals", Section 12, Heat Transfer, John Wiley & Sons, Inc., 1975. However, with the advent of computer simulation and modelling techniques, heat flow calculations for complexly shaped castings are now made using computer analysis techniques such as the ProCAST™ program commercially available from UES, Inc. Software Products Center, Annapolis, Md. Such simulation techniques allow the determination of cooling rates at any location within the die cavity 44, so no assumptions are required about where the slowest-cooling location will be found.

Whatever technique is used, the useful result for the present technique is a critical cooling curve, expressed in °K. per second (or °C. per second or °F. per second) experienced at the cooling location X, numeral 54, during casting. This cooling location and its critical cooling curve are the limiting consideration in the casting operation, because if the amorphous state is retained at this cooling location and at this critical cooling rate, the amorphous state will be retained throughout the entire cast article. As is apparent, the cooling location and critical cooling rate depend upon the geometry of the article and mold cavity, properties of the casting charge, properties of the mold, and cooling procedures. The following discussion will deal with a hypothetical critical cooling curve determined by one of the techniques discussed previously.

Figure 4:
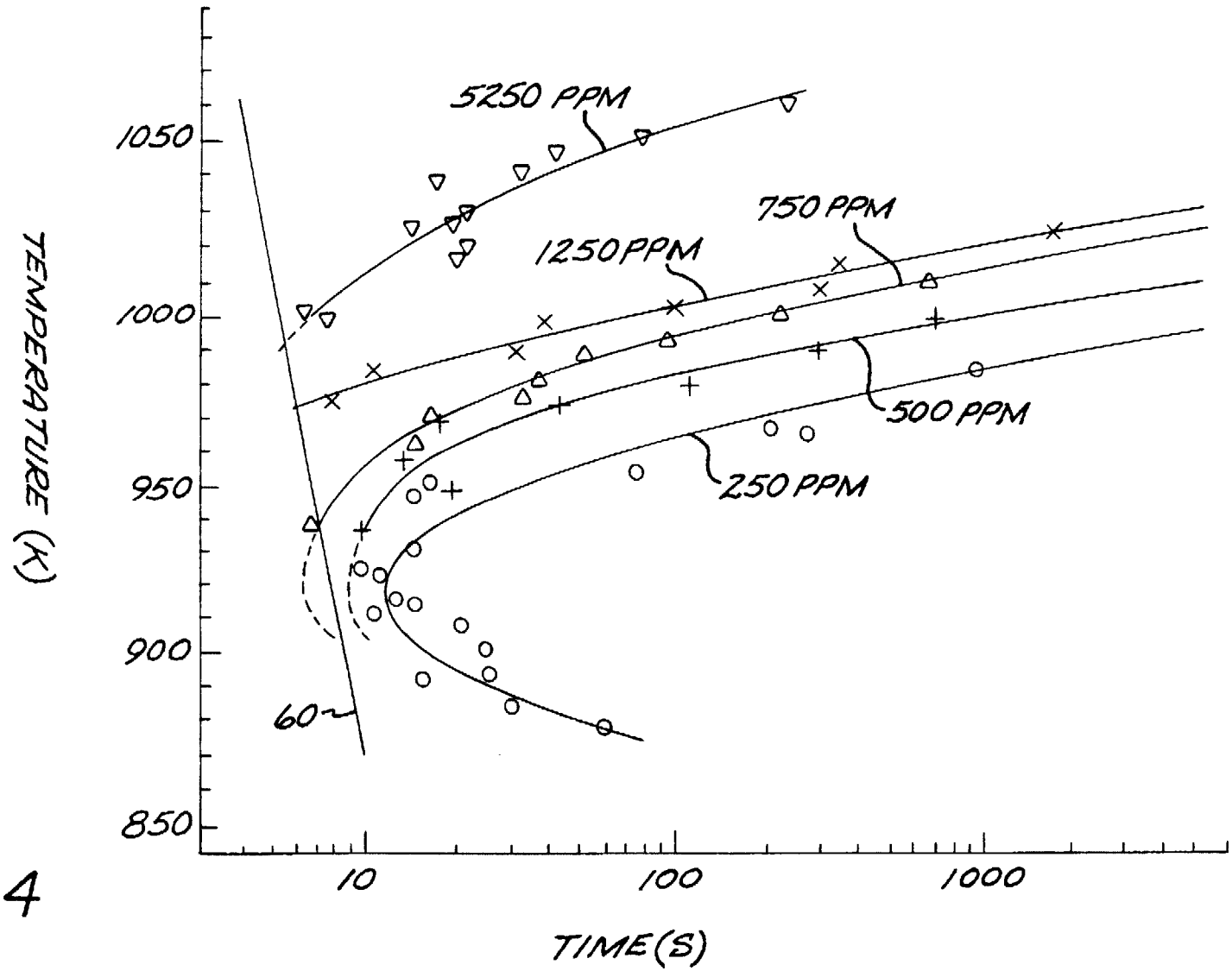
FIG. 4 is a copy of the graph of FIG. 3, with a superimposed critical cooling curve.

FIG. 4 is a copy of FIG. 3, but with a critical cooling curve 60 resulting from the above-described techniques superimposed thereon. The critical cooling curve 60 intersects the TTT crystallization curves (or their extrapolations) for 5250 ppm oxygen, 1250 ppm oxygen, and 750 ppm oxygen. These oxygen contents are all therefore too high, because the cooling location X in the cast article (and possibly other locations as well) will become crystalline if the casting charge has any of these oxygen contents. The critical cooling curve 60 does not intersect the TTT crystallization curves for 500 ppm oxygen and 250 ppm oxygen. If the casting charge has 500 ppm oxygen or less, the cooling location X in the cast article, and thence all other locations within the cast article, will have the amorphous structure, and no crystallized regions will be present. (It is possible that even some slightly higher oxygen contents than 500 ppm would be operable, based upon an interpolated TTT crystallization curve between the 750 ppm oxygen curve and the 500 ppm oxygen curve. Such an interpolation may be used, if desired. On the other hand, it is usually desirable to allow a reasonable margin for error in the measuring and melting operations.)

The selected oxygen content is therefore one whose TTT crystallization curve is not intersected by the critical cooling curve 60, 500 ppm oxygen or less in the example of FIG. 4. The most preferred oxygen content is one that is represented by a TTT crystallization curve that is not intersected by the critical cooling curve, but, within that constraint, is as large as possible. Thus, in this case, a casting charge consisting of the base composition plus 500 ppm oxygen is preferred to a casting charge with significantly less than 500 ppm oxygen, such as 250 ppm oxygen or less. The reason for this preference is cost. Most of the oxygen enters the casting charge as impurities in the constituents that are melted together to form the casting charge. In the preferred case, where on the order of about 50 atomic percent of the alloy is zirconium, the cost of zirconium metal is a major factor in the production cost of the article. At the present time, for example, the cost of zirconium metal with 1400 ppm oxygen is about $12 per pound, and the cost of zirconium metal with 400 ppm oxygen is about $60 per pound. (These values will change, but they illustrate the large increase in materials cost to achieve lower oxygen content.) The present approach permits the process designer to select an oxygen content for the casting charge that is sufficiently low to permit the article to be fully amorphous when cast, but no lower than necessary to achieve this objective for cost reasons.

The casting charge is prepared, numeral 26. The constituents of the casting charge are obtained and melted together, typically under vacuum or an inert atmosphere to prevent introduction of additional oxygen into the melt. The constituents are carefully selected so that the composition-weighted average oxygen content does not exceed that determined using the approach described in relation to FIG. 4. Alternatively, the oxygen content of the casting charge can be reduced using refining techniques. For example, additions of magnesium, calcium, or lithium react with the oxygen in the alloy to form oxides of these elements. However, normally these oxides are thereafter necessarily removed from the casting metal, necessitating further processing operations.

Figure 5:
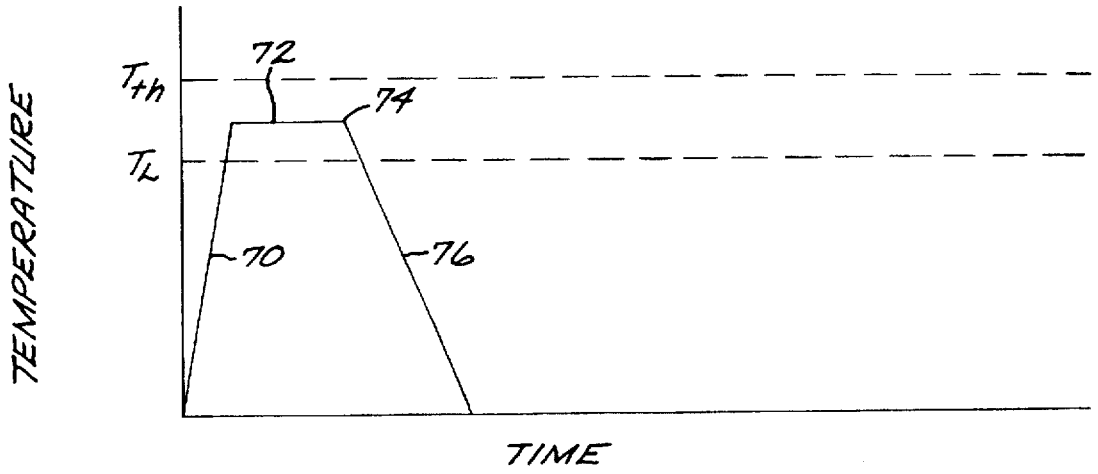
FIG. 5 is a schematic graph of metal temperature as a function of time for a first embodiment of the casting procedure.
Figure 6:
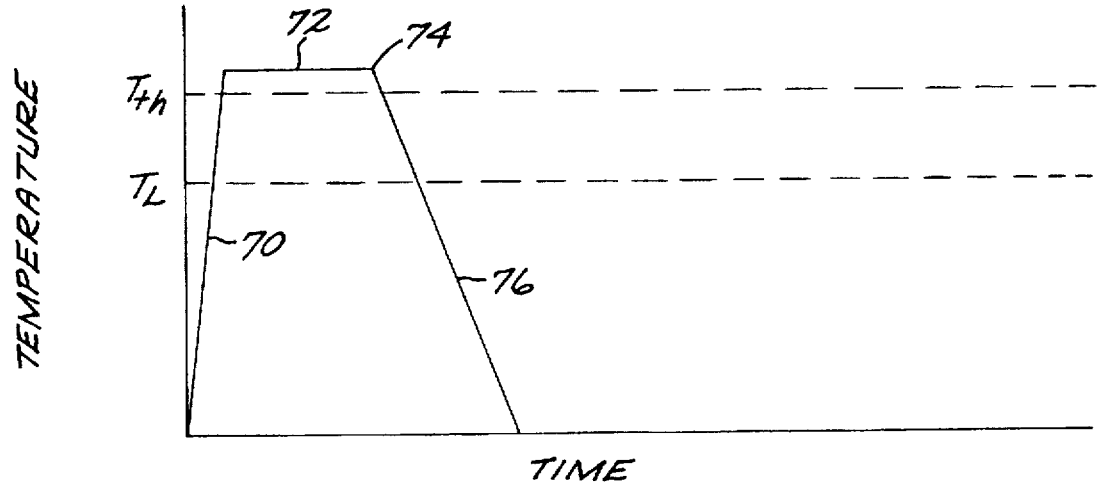
FIG. 6 is a schematic graph of metal temperature as a function of time for a second embodiment of the casting procedure.
Figure 7:
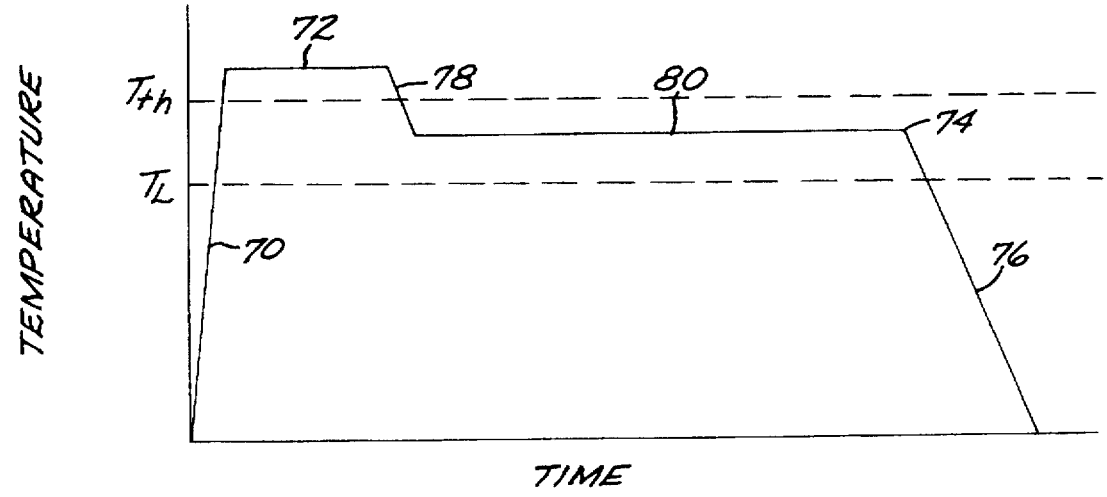
FIG. 7 is a schematic graph of metal temperature as a function of time for a third embodiment of the casting procedure.

The casting charge is heated to the casting temperature, numeral 28, and thereafter cast into the mold, cooled, and solidified, numeral 30. FIGS. 5–7 illustrate three heating, casting, and cooling temperature-time profiles that are within the scope of the invention. In the approach of FIG. 5, the casting charge is heated, numeral 70, to a temperature above $T_L$ but below $T_{th}$, held for a period of time, numeral 72, cast into the mold from the casting temperature, numeral 74, and allowed to cool, numeral 76. The significance of $T_{th}$, a "threshold temperature", will be discussed subsequently.

In a second approach illustrated in FIG. 6, the casting charge is heated, numeral 70, to a temperature above $T_{th}$, held for a period of time, numeral 72, cast into the mold from the casting temperature, numeral 74, and allowed to cool, numeral 76. In a third approach illustrated in FIG. 7, the casting charge is heated, numeral 70, to a temperature above $T_{th}$ (which is also above $T_L$), held for a period of time at that temperature, numeral 72, cooled to a temperature above $T_L$ but below $T_{th}$, numeral 78, held for an extended period of time at that temperature, numeral 80, cast into the mold from the casting temperature, numeral 74, and allowed to cool, numeral 76.

All three approaches are operable, but those depicted in FIGS. 6 and 7 are preferred. "Overheating" to a temperature above the threshold temperature $T_{th}$, as depicted in FIGS. 6 and 7, is associated with improved casting performance. The metal may thereafter be cast from a temperature above $T_{th}$, as in FIG. 6, or from a lower temperature above $T_L$ but below $T_{th}$, as in FIG. 7. It is more preferred to cast from the lower temperature as in FIG. 7, to increase the time available to cool past the nose of the TTT crystallization curve, see FIG. 4.

The approach of FIG. 7 is also preferred because of the availability of the holding period 80 at a lower temperature than the temperature of the holding period 72. In commercial casting production operations, it is often necessary that the molten metal be held at elevated temperature for a period of time while molds are prepared and brought into casting position, while fluid connections are made, and the like. The inventors have found that, after heating to a temperature above $T_{th}$ for a period of time, numeral 72 in FIG. 7, the improved performance resulting from this overheating is retained even following holding at a lower temperature below $T_{th}$ and above $T_L$ for extended periods. The holding period 80 is not of indefinitely long duration, because eventually the oxides may be expected to re-form. Also, it is expected that there may be oxygen contents so high that the heating above $T_{th}$ would be ineffective, because the oxygen content is greater than the solubility limit of oxygen in the alloy even at elevated temperatures. These limitations to the processing, if present, are related to the specific alloy system chosen, and may be readily determined for any particular alloy system by measurements of re-forming of the oxide and measurements of oxygen solubility, respectively.

Figure 8:
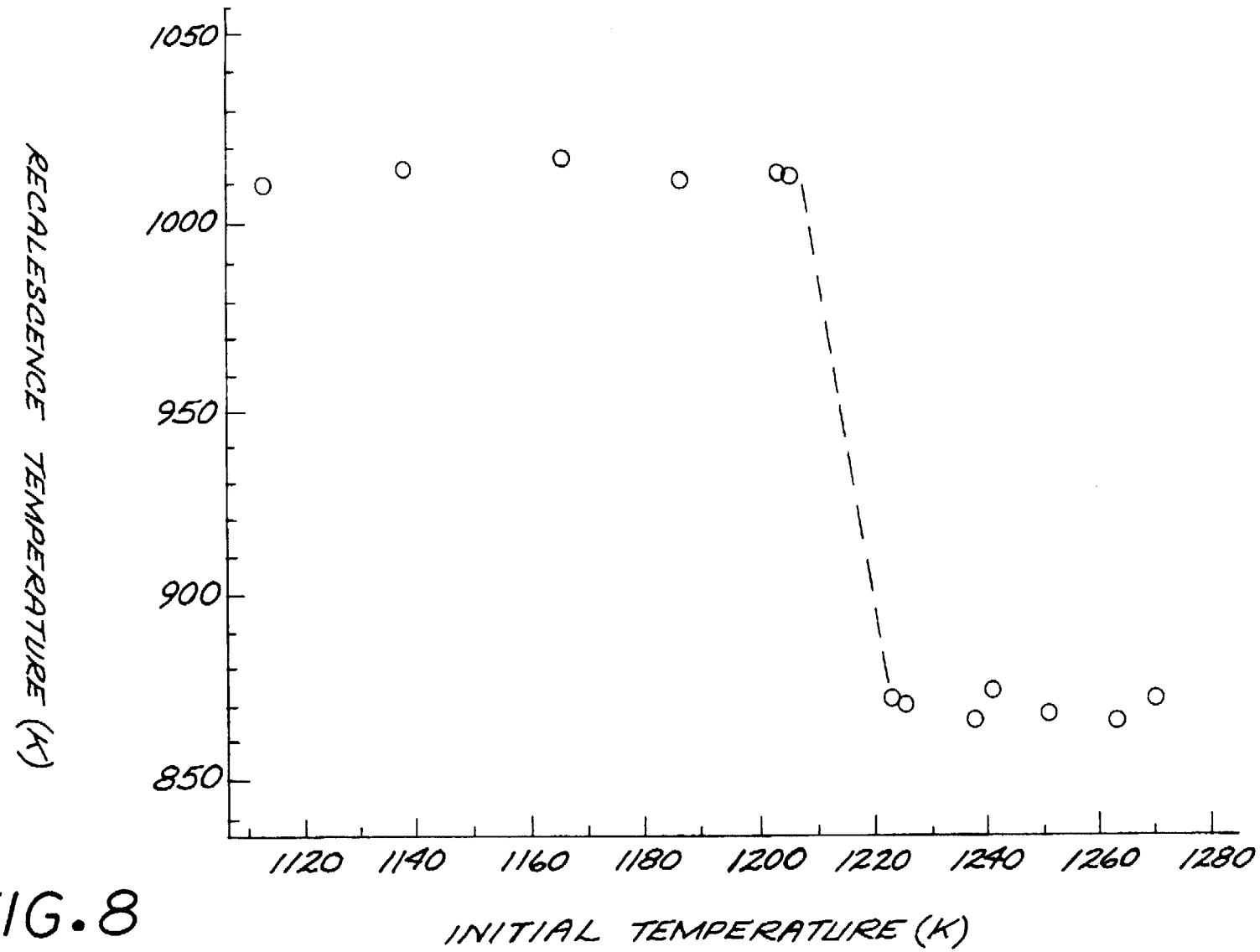
FIG. 8 is a graph of recalescence temperature as a function of initial temperature for a bulk-forming amorphous alloy.

The value of $T_{th}$ for a casting charge alloy is readily measured. A series of specimens of the alloy composition are heated to various initial temperatures above $T_L$ and then cooled by free cooling. Upon cooling, there is a recalescence effect observed. That is, as the specimen is cooled, there is a brief period of reheating observed at an intermediate temperature, due to recalescence caused by crystal nucleation and growth within the metal. In FIG. 8, the recalescence temperature is plotted as a function of the initial temperature for the amorphous base composition alloy containing, in atomic percent, 52.5 percent zirconium, 5 percent titanium, 17.9 percent copper, 14.6 percent nickel, and 10 percent aluminum, plus a 250 ppm oxygen addition to make the casting charge. For specimens initially heated to a temperature of less than about 1210° K., the recalescence temperature is about 1010° K. For specimens initially heated to above about 1220° K., the recalescence temperature is about 870° K., indicating a higher resistance to crystallization. The break in the curve, at about 1215° K., marks the threshold temperature, $T_{th}$.

The explanation of the existence and origin of the threshold temperature $T_{th}$ is not known with certainty, and the advantageous results associated with heating above the threshold temperature are attained regardless of the explanation. However, it is believed that $T_{th}$ corresponds to the liquidus temperature of a second phase in the melt, possibly an oxygen-rich phase. This second phase, when present, can serve as a heterogeneous nucleation site for crystallization of the amorphous material to form the undesired crystallized phase after casting. Heating above $T_{th}$ dissolves the second phase. Upon cooling, re-formation of the second phase is a nucleation and growth process that does not occur rapidly in the range between $T_L$ and $T_{th}$, permitting the long hold time 80. Thus, while the present invention is operable for the approach of FIG. 5, it is preferred to heat above $T_{th}$ and then cast either from a temperature above $T_{th}$, as in FIG. 6, or from a temperature between $T_{th}$ and $T_L$, as illustrated in FIG. 7.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for casting an article of a bulk-solidifying amorphous metallic alloy, comprising the steps of:

furnishing a closed casting mold having a die cavity defining the shape of the article;

selecting an amorphous metallic alloy base composition which may be cooled from the melt yet retain an amorphous metallic structure, and whose crystallization behavior during cooling is dependent upon its oxygen content;

determining an operable oxygen content of the base composition for casting the base composition in the casting mold while retaining an amorphous state;

preparing a casting charge of the base composition having an oxygen content of no greater than the operable oxygen content;

heating the casting charge to a casting temperature greater than the crystallized melting temperature of the casting charge; and casting the casting charge into the casting mold and permitting the casting charge of metal to cool and solidify at a cooling rate sufficiently high to retain the amorphous state in the metallic alloy.

2. The method of claim 1, wherein the step of furnishing a casting mold includes the step of furnishing a die casting mold.

3. The method of claim 1, wherein the base composition is a member of an alloy class which may be cooled from the melt at a cooling rate of less than about 500° C. per second, yet retain an amorphous metallic structure.

4. The method of claim 1, wherein the step of selecting includes the step of selecting a base composition having zirconium therein.

5. The method of claim 1, wherein the step of selecting includes the step of selecting a base composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

6. The method of claim 1, wherein the step of selecting includes the step of selecting a base composition, in atomic percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent.

7. The method of claim 1, wherein the step of determining an operable oxygen content includes the steps of obtaining a family of TTT crystallization curves of the bulk-solidifying amorphous metallic alloy for a range of oxygen contents;

establishing a critical cooling curve experienced at a cooling location within the article during casting of the bulk-solidifying amorphous metallic alloy in the casting mold from the casting temperature; and selecting an operable oxygen content such that the critical cooling curve does not intersect the TTT crystallization curve for the selected oxygen content.

8. The method of claim 1, wherein the step of preparing includes the step of selecting constituents having a base composition-weighted oxygen content of no greater than the operable oxygen content; and melting the constituents together to form the base composition.

9. The method of claim 1, wherein the step of heating includes the step of heating the casting charge to a threshold temperature sufficiently greater than the crystallized melting temperature that heterogeneous crystallization nucleation sites within the casting charge are eliminated.

10. The method of claim 9, wherein the step of casting includes the step of casting the casting charge from a temperature of no less than the threshold temperature.

11. The method of claim 9, wherein the step of heating further includes, after the step of heating the casting charge to the threshold temperature, the step of cooling the casting charge of metal to the casting temperature that is less than the threshold temperature and no less than the crystallized melting temperature.

12. The method of claim 11, including an additional step, after the step of cooling, of holding the casting charge for a period of time at a temperature of no less than the crystallized melting temperature and no greater than the threshold temperature, and thereafter casting the casting charge.

13. A method for casting an article of a bulk-solidifying amorphous metallic alloy, comprising the steps of:

furnishing a casting mold defining the shape of the article;

selecting a bulk-solidifying amorphous metallic alloy base composition which may be cooled from the melt at a cooling rate of less than about 500° C. per second yet retain an amorphous metallic structure, and whose crystallization behavior during cooling is dependent upon its oxygen content;

determining an operable oxygen content of the base composition for casting the base composition in the casting mold while retaining an amorphous state;

preparing a casting charge of the base composition having an oxygen content of no greater than the operable oxygen content;

heating the casting charge to a threshold temperature sufficiently greater than a crystallized melting temperature of the casting charge such that heterogeneous crystallization nucleation sites within the casting charge are eliminated; and thereafter casting the casting charge into the casting mold and permitting the casting charge of metal to cool and solidify at a rate of less than about 500° C. per second such that the casting charge is amorphous.

14. The method of claim 13, including an additional step, after the step of heating the casting charge to a threshold temperature and before the step of casting, of cooling the casting charge of metal to a casting temperature of greater than a crystallized melting temperature and no greater than the threshold temperature.

15. The method of claim 13, wherein the step of selecting includes the step of selecting a base composition having zirconium therein.

16. The method of claim 13, wherein the casting mold is a closed casting mold having a die cavity therein.

17. The method of claim 13, wherein the step of determining includes the steps of obtaining a family of TTT crystallization curves of the bulk-solidifying amorphous metallic alloy for a range of oxygen contents, establishing a critical cooling curve experienced at a cooling location within the article during casting of the bulk-solidifying amorphous metallic alloy in the casting mold from the casting temperature, and selecting an operable oxygen content such that the critical cooling curve does not intersect the TTT crystallization curve for the selected oxygen content.

18. A method for casting an article of a bulk-solidifying amorphous metallic alloy, comprising the steps of:

furnishing a closed casting mold having a cavity therein defining the shape of the article;

selecting a bulk-solidifying amorphous metallic alloy base composition which may be cooled from the melt at a cooling rate of less than about 500° C. per second yet retain an amorphous metallic structure, and whose crystallization behavior during cooling is dependent upon its oxygen content;

determining an operable oxygen content of the base composition for casting the base composition in the casting mold while retaining an amorphous state, wherein the step of determining an operable oxygen content includes the steps of obtaining a family of TTT crystallization curves of the bulk-solidifying amorphous metallic alloy for a range of oxygen contents, establishing a critical cooling curve experienced at a cooling location within the article during casting of the bulk-solidifying amorphous metallic alloy in the casting mold from the casting temperature, and selecting an operable oxygen content such that the critical cooling curve does not intersect the TTT crystallization curve for the selected oxygen content;

preparing a casting charge of the base composition having an oxygen content of no greater than the operable oxygen content;

heating the casting charge to a casting temperature greater than a crystallized melting temperature of the casting charge; and casting the casting charge into the casting mold and permitting the casting charge of metal to cool and solidify at a rate of less than about 500° C. per second such that the casting charge is amorphous.

19. The method of claim 18, wherein the step of determining an operable oxygen content includes the step of selecting as the operable oxygen content the greatest oxygen content that permits retaining the amorphous state.

* * * * *